US006508292B1

(12) United States Patent
Saperas

(10) Patent No.: US 6,508,292 B1
(45) Date of Patent: Jan. 21, 2003

(54) RETRACTABLE MOSQUITO NET

(75) Inventor: Jordi Saperas, Llinars del Valles (ES)

(73) Assignee: Fivent, S.A., Llinars del Valles (ES)

( * ) Notice: Subject to any disclaimer, the term of this patent is extended or adjusted under 35 U.S.C. 154(b) by 0 days.

(21) Appl. No.: 09/537,994

(22) Filed: Mar. 29, 2000

(51) Int. Cl.[7] ..... E06B 7/16
(52) U.S. Cl. ..... 160/42; 160/272
(58) Field of Search ..... 135/117; 52/73.78, 52/101; 160/268.1, 266, 269–271, 272, 273.1, 40, 41, 42, 294, 306, 305, 313, 317, 318

(56) References Cited

U.S. PATENT DOCUMENTS 4,359,081 A * 11/1982 Brower ..... 160/243
4,638,844 A * 1/1987 Hayashiguchi ..... 160/23.1
4,707,018 A * 11/1987 Gavagan ..... 160/23.1
4,825,921 A * 5/1989 Rigter ..... 160/23.1
5,099,905 A * 3/1992 Rigter ..... 160/273.1
5,123,474 A * 6/1992 Smith ..... 160/310
5,392,835 A * 2/1995 Wildt ..... 160/269
5,620,039 A * 4/1997 Delgado ..... 160/265
5,671,790 A * 9/1997 Anderson ..... 160/24
6,082,432 A * 7/2000 Kissinger ..... 160/290.1
6,186,215 B1 * 2/2001 DeYoung ..... 160/290.1

* cited by examiner

*Primary Examiner*—James O. Hansen
*Assistant Examiner*—Jerry A. Anderson
(74) *Attorney, Agent, or Firm*—Crowell & Moring LLP

(57) ABSTRACT

Improved retractable mosquito net, of the type designed to be fitted to the structure of a window opening or door, there being a fly mesh or cloth (11) which slides sideways upon two profiles (15) and (15') optionally provided with hidden locks (10) and (10') the fly cloth has in its lower part a profile (12) provided with a central channel (13) in which a handle (14) is attached and slides provided with, side plugs (16) and (16'), the lower part of the profile a dust excluder (13').

9 Claims, 3 Drawing Sheets

RETRACTABLE MOSQUITO NET

OBJECT OF THE INVENTION

The present specification relates to an improved retractable mosquito net, whose purpose is, on the one hand, to protect against the entry of mosquitos and the like into a building through the windows, by fixing the fly cloth in an appropriate way to a support which surrounds the window or door area where the mosquito net is fitted. On the other hand, in accordance with its characteristic of being able to be rolled up in a vertical upwards or horizontal direction when the use of the fly cloth or protective mesh is not required, it remains duly retracted inside the adaptation area, allowing the window or door to be used in the conventional way, without the fly cloth or mesh obstructing normal use of the gap or opening of the window or door.

The mosquito net is capable of hermetically sealing the perimeter against the access of mosquitos and the like, as it is provided with a protective draught excluder, situated in the lower part of the profile that holds the operating handle of the mosquito net in question, which is effective in preventing the entry of even smaller animals.

This invention is provided with a friction bearing situated between the front end and the axis, to facilitate its rotation, and at the same time considerably reducing the friction coefficient, incorporating a double headstock to compensate for possible errors in the measurements taken prior to its definitive installation.

At the same time the invention incorporates an adjustable lock for adjusting the mosquito net when its surface is becoming irregular.

FIELD OF THE INVENTION

The application of this invention is within the industry devoted to the manufacture of mosquito nets and the like, and may also be manufactured by the industry devoted to metallic fittings, blinds and the like.

BACKGROUND OF THE INVENTION

The applicant is aware of the existence at the present time of a plurality of mosquito nets made up of a cloth or mesh fixed to a frame, which is subsequently fixed in the opening of a window or door, consequently preventing the entry of insects of whatever kind through the window opening.

The embodiment of this type of mosquito net obviously implies completely closing the access through the door or window as, logically, when a support is incorporated upon which the fly cloth is situated, acting as a sliding connection for the same in its sides, this cannot be constantly removed to allow people to pass through the doors, or to gain access to a window opening.

Consequently, if a frame is fixed, this implies closing the opening where it is fixed, and the perimeter of the frame must be sealed, as the insects by virtue of their small size may pass through the gaps around the perimeter between the wall and the frame.

The applicant is aware of the use of fly curtains which are installed in windows and doors, and which, having great mobility, allow insects to enter by virtue of this mobility.

The evident solution to the problem currently existing in this field, would be to have a mosquito net capable of adapting to the closing structure of the door or window, acting as a secondary blind, and which would at the same time seal the opening of the door or window, preventing the entry of insects through its perimeter.

However, the applicant has no knowledge of a currently existing invention provided with the features indicated hereinbefore as being suitable.

DESCRIPTION OF THE INVENTION

The improved retractable mosquito net proposed by the invention constitutes in itself a clear novelty within its field of application, as it presents a suitable fixing structure to the surface of the frame or fitting where the closing elements of a door or window are fixed, without altering the normal operation of the same; having sealing means on its perimeter, and at the same time may be withdrawn when its use is not considered to be appropriate, at which time it remains completely retracted inside a transverse body situated in the upper part of the right or left side or both, which are at the same time the fixing reinforcements for the retraction mechanism, staying in this position until its services are required again.

More specifically, the improved retractable mosquito net that is the object of the invention, is made up of two counter headstocks fixed to the wall in the case of vertical operation, upon which parts called headstocks are fixed, which act appropriately to fix the ends of the body that holds the internal axis where the fly cloth or mesh is retracted, presenting a biconical spring inside and the relevant fixing element to the profile of the axis incorporated inside an elongated drawer or casing, which has a dust excluder to prevent any insect from gaining access to the inside.

In the side parts the profiles are fixed with hidden locks or by means of cables that may be installed as an option, the fly cloth having in its lower part transversely situated profiles, upon which a handle is fixed for applying traction to the same; the holding profile of the handle has in its lower part a form provided with a sealing dust excluder which adapts to the lower part of the frame of the window where the mosquito net is fixed.

The invention has an adjustable or hidden lock and incorporates a friction bearing, facilitating retraction with the flap which is incorporated between the headstock and the axis to allow its rotation, thus diminishing the friction coefficient, and incorporating a double headstock to compensate for measurement errors in its installation and to facilitate its anchorage by pressure.

DESCRIPTION OF THE DRAWINGS

To complement the present description and in order to promote a better understanding of the invention's characteristics, the present specification is accompanied by two sheets of drawings which form an integral part of the same; in an illustrative and non-restrictive way these drawings represent the following.

PREFERRED EMBODIMENT OF THE INVENTION

Figure 1:
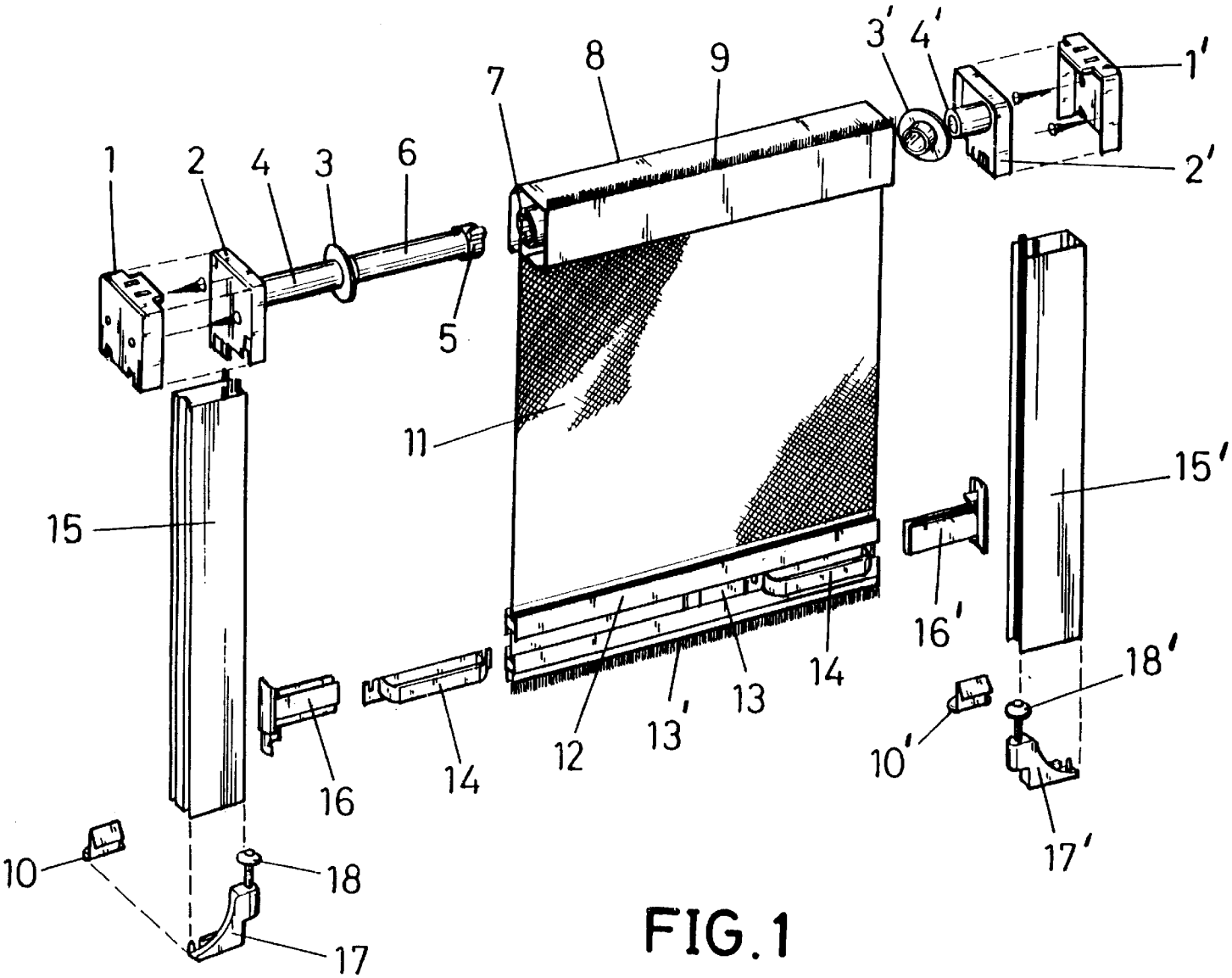
FIG. 1.—Shows a perspective view of the object of the invention in the case of side operation, in respect of an improved retractable mosquito net, the constitutive parts of the same being represented totally separately, in order to view the constitutive elements of the invention.
Figure 2:
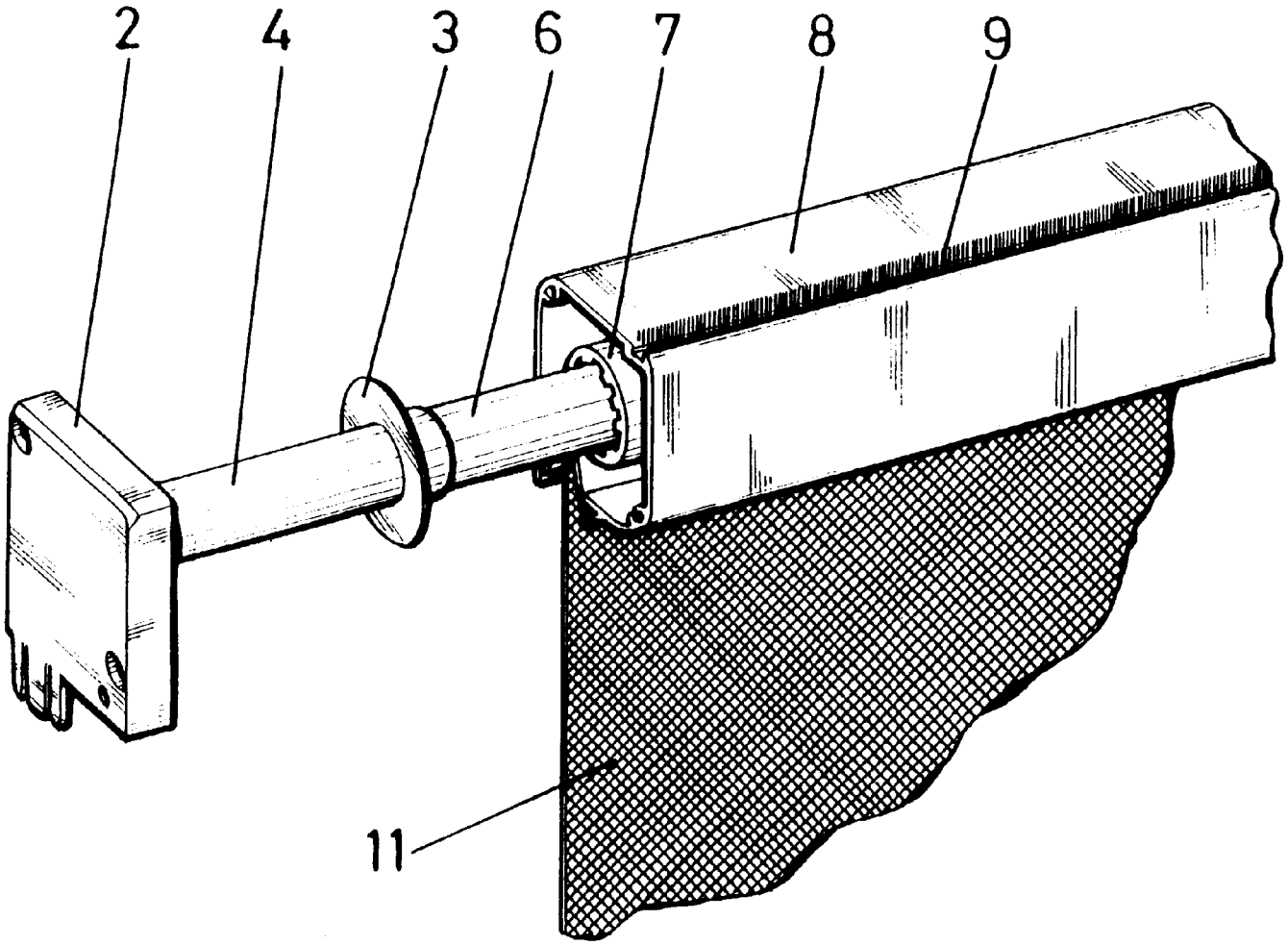
FIG. 2.—Corresponds to a view of the end of the mosquito net's retraction mechanism, which is implemented by a friction bearing.
Figure 3:
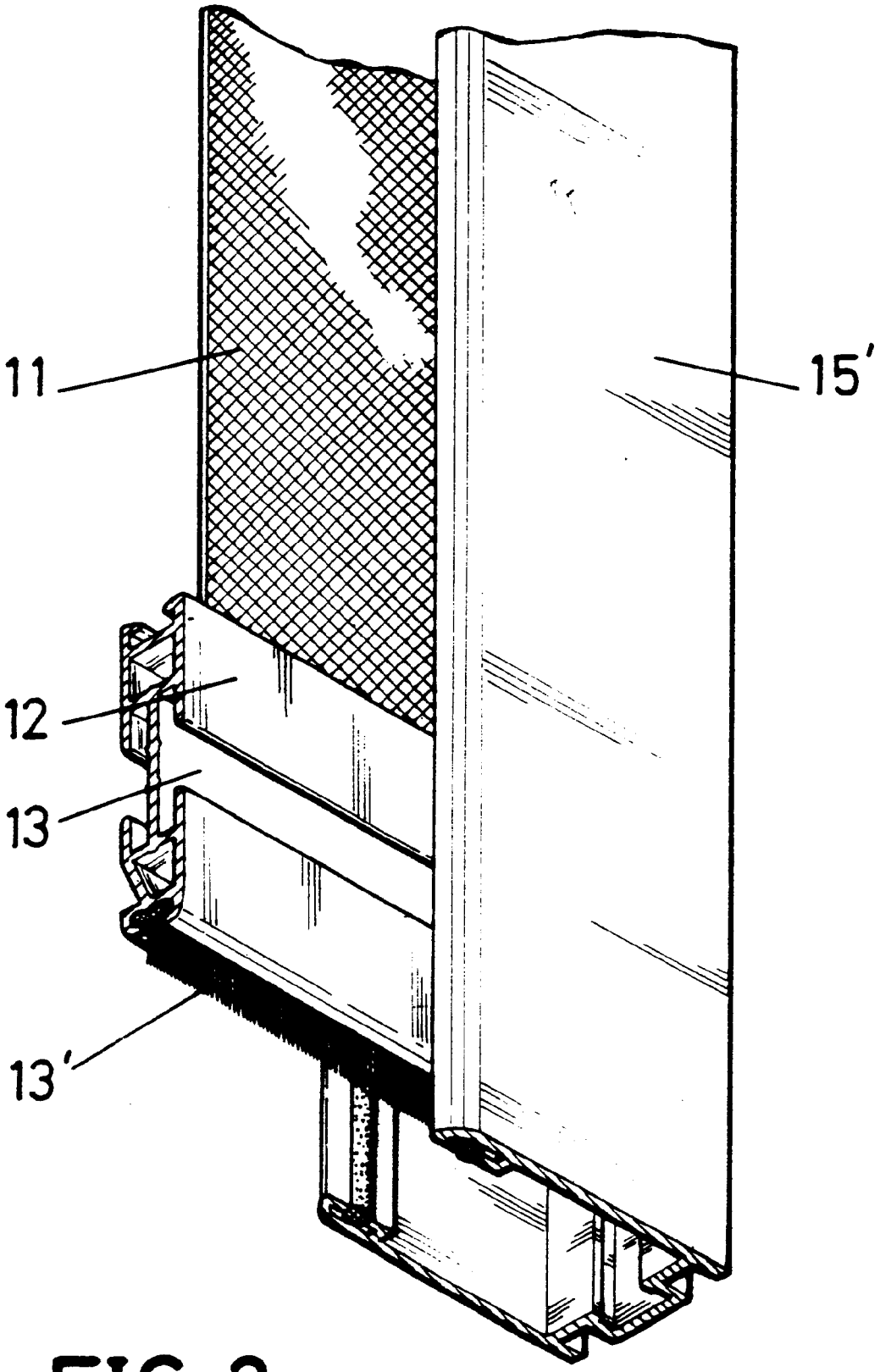
FIG. 3.—Shows a detail in section of the lower area of the mosquito net, which has a groove for incorporating the handle part, as well as the sealing part situated in the lower area which prevents the entry of small insects.

From these drawings it may be observed how the invention in respect of an improved retractable mosquito net is made up of two identical counter headstocks (1) and (1'), which are fixed to the side walls of the opening where the mosquito net is to be installed, two identical parts (2) and (2') called headstocks being fixed to the counter headstocks (1) and (1') by means of conventional nuts and bolts, after which bearings (3) and (3') are joined on conical, cylindrical protuberances (4) and (4') and in turn upon these the biconical springs (6) are fixed, which terminate in an adaptation area (5) which is fixed upon parts (7) which form the casing of the spring between the profile of the axis without distorting the spring, situated on a storage profile (8). The latter holds on its upper front part a dust excluder (9) which seals the storage drawer at the upper part; the mosquito net (11) slides along rails with plush seals (15) and (15'), which are also optionally provided with a hidden lock (10) and (10'), the fly cloth or mesh (11) appearing through rails (15) and (15') which have optionally a hidden lock (10) and (10'), the fly cloth or mesh (11) having in its lower part a profile (12) provided with a central channel (13), in which a handle (14) is attached, the handle being sealed by plugs (16) and (16') which facilitate the sliding action, the lower part of the profile (12) having a dust excluder (13').

It must be pointed out that the sealing plugs have creases designed to project on the outside of the rails and at the same time seal the mosquito net, acting at the same time as parts that facilitate storage.

Likewise, in FIG. 1 it may be observed that the invention has an adjustable lock (17) and (17') provided with an appropriate connection for operation (18) and (18') respectively.

The improved retractable mosquito net is presented as a vertical retractable mosquito net which constitutes the most practical way of protecting the inside of a residence, business premises or the like against all kinds of insects, being easy to retract, which allows it to be stored protected from dust and the like in the winter, when it is put away, and to be used when the hottest time of year arrives.

The invention is capable of being used in combination with screens made up of retractable solar filters and at the same time it does not require any kind of maintenance, being manufactured of fireproof material.

The profiles are manufactured in varnished and anodized aluminum, the mosquito net proper being made of a grey material, which may be combined with solar filters of different colours and thicknesses.

The invention includes a drawer with a double dust excluder or hermetic seal, being provided with a mesh and a bearing.

Any expert in the field may understand the scope of the invention and the advantages arising from the same.

The materials, shape, size and arrangement of the elements will be subject to variation, provided that this does not imply any alteration to the essential nature of the invention.

The terms in which this specification has been described are to be taken always in a broad and non-restrictive sense.

I claim:

1. A retractable mosquito net for windows and door openings, comprising a storage profile, a headstock device arranged on each side of the storage profile, a net material with one end thereof operatively connected within the storage profile so as to be retractably stored within the storage profile, rails arranged adjacent each side of the net material such that the net material extends thereinto for movement into and out of a retractable storage position within the storage profile, and a handle profile arranged at a second end of the net material opposite the one end, wherein a excluder device is operatively connected to the storage profile to hermetically seal a storage drawer therein, the net material being fully storable in the storage drawer in the retractable storage position.

2. A retractable mosquito net for windows and door openings, comprising a storage profile, a headstock device arranged on each side of the storage profile, a net material with one end thereof operatively connected within the storage profile so as to be retractable stored within the storage profile, rails arranged adjacent each side of the net material such that the net material extends thereinto for movement into and out of a retractably storage position within the storage profile, and a handle profile arranged at an end of the net material opposite the one end, wherein each headstock device comprises counter-headstock members configured to be attached to a window or door opening and joined with the storage profile via bearings and biconical springs allowing the net material to be held in any desired position between the retractable storage position and a fully extended position.

3. The retractable mosquito net according to claim 2, wherein a excluder device is operatively connected with the storage profile to hermetically seal a storage drawer therein, the net material being fully storable in the storage drawer in the retractable storage position.

4. The retractable mosquito net according to claim 3, wherein the storage profile, rails and handle profile define an outer configuration fitting a window fixing profile or door jambs.

5. The retractable mosquito net according to claim 4, wherein the rails comprise seals arranged to allow the net material to move along a length of the rails between the retractable storage position and a fully extended position.

6. The retractable mosquito net according to claim 5, wherein the rails each include a hidden lock mechanism.

7. The retractable mosquito net according to claim 2, wherein the rails each include a hidden lock mechanism.

8. The retractable mosquito net according to claim 7, wherein side plugs are operatively connected with the handle profile and rails for facilitating sliding action.

9. The retractable mosquito net according to claim 8, wherein an adjustable locking mechanism is arranged at a lower end of each of the rails.

* * * * *